US006629121B1

(12) United States Patent
Ishikawa et al.

(10) Patent No.: US 6,629,121 B1
(45) Date of Patent: Sep. 30, 2003

(54) SURFACE ACOUSTIC WAVE-MATCHED FILTER AND DIFFERENTIAL DETECTOR FOR DEMODULATING SPREAD SPECTRUM SIGNALS

(76) Inventors: Hiroyasu Ishikawa, 6-14-15-106, Ryouke, Urawa-Shi (JP); Hideyuki Shinonaga, 4-13-6, Misugidai, Hannou-Shi (JP)

( * ) Notice: Subject to any disclaimer, the term of this patent is extended or adjusted under 35 U.S.C. 154(b) by 0 days.

(21) Appl. No.: 09/413,946

(22) Filed: Oct. 7, 1999

(30) Foreign Application Priority Data

Oct. 7, 1998 (JP) ..... 10-284961

(51) Int. Cl.[7] ..... G06G 7/12

(52) U.S. Cl. ..... 708/815; 375/343

(58) Field of Search ..... 708/815; 310/311, 310/313 R, 313 A; 333/193; 375/343, 143, 142, 150, 130

(56) References Cited

U.S. PATENT DOCUMENTS 5,226,004 A * 7/1993 Mitsutsuka ..... 708/815
5,243,250 A * 9/1993 Mitsutsuka ..... 708/815
5,815,055 A * 9/1998 Eguchi et al. ..... 708/815
6,047,306 A * 4/2000 Hikita et al. ..... 708/815

* cited by examiner

*Primary Examiner*—Tan V. Mai
(74) *Attorney, Agent, or Firm*—Lachenbach Siegel, LLP

(57) ABSTRACT

A surface acoustic wave-matched filter is disclosed which comprises: an input transducer provided on a piezoelectric substrate surface; a first output transducer, that is, a forward output transducer encoded in correspondence to a pseudo-noise code sequence for spectrum spreading and provided on the substrate surface; and a second output transducer, that is, a backward output transducer encoded in correspondence to the pseudo-noise sequence code and provided on the substrate surface at the succeeding to the forward output transducer by the length of the pseudo-noise code sequence as viewed from the input transducer. With the use of the surface acoustic wave-matched filter, it is possible to realize a differential detector for demodulating spread spectrum signals.

1 Claim, 6 Drawing Sheets

SURFACE ACOUSTIC WAVE-MATCHED FILTER AND DIFFERENTIAL DETECTOR FOR DEMODULATING SPREAD SPECTRUM SIGNALS

BACKGROUND OF THE INVENTION

1. Technical Field to Which the Invention Pertains

The present invention relates to a surface acoustic wave-matched filter for demodulation use in a DS (Direct Sequence)-SS (Spread Spectrum) communication system, which is applicable to any of all radio communication systems such as a fixed satellite communication system, a mobile satellite communication system, a fixed land radio communication system, a land mobile communication system, a radio LAN system and a private radio communication system, or any of all wire communication systems which transmit information over any of lines, such as optical fibers, coaxial cables or similar wires. The invention also pertains to a differential detector which uses the matched filter to demodulate spread spectrum signals in case of employing a quadrature phase shift keying (QPSK) system as a data signal modulating technique.

2. Prior Art

In a conventional DS-SS communication system, the bandwidth of a transmission signal is spread normally by multiplying a phase-modulated data signal by a pseudo noise code (PN code), or by phase-modulating an data signal multiplied by the PN code. To demodulate spread spectrum signals, it is customary in prior art to use two kinds of demodulation technique: (1) a demodulation system of a despreading scheme and (2) a demodulation system using a matched filter. In the systems, the despreading demodulation system (1) requires the receiving side to recover a timing clock from the received signal for despreading it. In a communication system for use indoors, such as a radio LAN, however, the communication channel becomes a multi-path fading channel, making the timing clock recovery or the carrier recovery very difficult and the required receiver construction very complex.

On the other hand, the demodulation system (2) using the matched filter could be implemented by two methods, i.e. a method of demodulating the spread spectrum signal by a surface acoustic wave filter (hereinafter referred to simply as a SAW filter) in the intermediate-frequency (IF) band, and a method of demodulating the spread spectrum signal by a digital signal processing technique after converting a received analog signal by an A/D converter to a discrete value. Now, a description will focus on a scheme using the SAW device.

The SAW filter is usually formed by two or more kinds of transducers such as input and output transducers deposited on a surface of a piezoelectric substrate. The input transducer generates a surface acoustic wave by the excitation of the substrate surface according to an applied voltage thereto of an electric signal. On the other hand, the output transducer outputs the voltage level of an electric signal converted from the surface acoustic wave generated by the input transducer. To demodulate the spread spectrum signal by the SAW filter, it is necessary that the weighting of the output transducer forming the SAW filter be so preset as to match with the PN code for spectrum spreading use. A SAW filter of the type, which has its output transducer thus associated so as to establish a correlation with the PN code thereto is called a SAW-matched filter.

When supplied with the spread spectrum signal, the SAW-matched filter outputs a phase-modulated signal having an information component as a pulse-like peak waveform of the correlation value when each of the code signals weighted for respective output transducers and the PN code of the input spread spectrum signal are completely in-phase with each other over the entire output transducer structure. Since this peak waveform of the correlation value is provided at each symbol period of the information signal, that is, each cycle period of the PN code, it is easily feasible to establish synchronization with the symbol period at the receiving side.

Next, it is necessary to make a decision on the data of the phase-modulated signal which is the output signal from the SAW-matched filter; a detection system in this case could be implemented by either of koherent and differential detection schemes. In general, the coherent detection scheme involves carrier recovery from the received signal but encounters much difficulty in the carrier recovery from the output signal of the SAW-matched filter since it does not have a continuous waveform but periodically has a pulse waveform of a short duration. For this reason, when the SAW-matched filter is used as a demodulating means for the spread spectrum communication system, it is customary to employ the differential detection scheme which does not require the carrier recovery. A description will be given below of examples of a transmitter and a receiver of a conventional spread spectrum communication system which uses a conventional SAW-matched filter and the differential detection scheme.

Examples of a transmitter and a receiver which implement the conventional spread spectrum communication system are depicted in FIGS. 3 and 4, respectively. Incidentally, the phase-modulating system used is a quadrature phase shift keying (QPSK) system.

In FIG. 3, reference numeral 21 denotes an input data train generator which generates a binary-coded information signal; 23 denotes a differential encoder which differentially encodes an input data sequence 22 of the binary-coded information signal to provide a differentially-encoded baseband information signal 24; 25 denotes a spread spectrum modulator which spreads the spectrum of the differentially-encoded baseband information signal 24; 26 denotes a multiplier which performs a binary multiplication of the differentially-encoded baseband information signal 24 and a pseudo-noise (hereinafter referred to as PN) code 28 from a PN code generator 27 to provide a baseband-spread spectrum signal 29; 27 denotes the PN generator which generates a PN code sequence 28 for spreading the spectrum of the differentially-encoded baseband information signal 24; 30 denotes a quadrature phase-shift keying (hereinafter referred to as QPSK) modulator which QPSK-modulates a baseband-spread spectrum signal 29; 31 denotes a multiplier which performs a multiplication of the baseband-spread spectrum signal 29 and a quadrature phase-shift keyed-signal (hereinafter referred to as a QPSK-signal) 33 from a QPSK signal generator 32 to provide a baseband spread spectrum/QPSK signal 34; 35 denotes a modulator which modulates the baseband spread spectrum/QPSK signal 34 from the QPSK modulator 30 to the radio frequency (RF) band signal by a carrier signal of a frequency $f_c$ which is output from a local oscillator 36 to provide an RF-band spread spectrum/QPSK signal 38; 39 denotes a bandpass filter which extracts from the RF-band spread spectrum/QPSK signal 38 frequency components necessary for transmission to provide a band-limited RF-band spread spectrum QFSK signal 40; 41 denotes a power amplifier which amplifies the output signal of the bandpass filter 39; and 43 denotes a transmitting antenna which radiates a power-amplified RF-band spread spectrum/QPSK transmitting signal 42.

In FIG. 4, there is depicted an example of a receiver which demodulates the RF-band spread spectrum/QPSK signal sent from the transmitter of FIG. 3. In FIG. 4, reference numeral 51 denotes a receiving antenna for receiving the RF-band spread spectrum/QPSK signal transmitted from the transmitting side; 52 denotes a bandpass filter for extracting from the received signal only frequency components necessary for the demodulation thereof; 54 denotes a frequency converter for converting the output signal 53 of the bandpass filter 52 to an intermediate-frequency (IF) band signal; 55 denotes a local oscillator for generating an RF-local signal 56 of a frequency $f_L$ for frequency-conversion use; 58 denotes a bandpass filter for extracting only an IF signal 59 of a frequency $f_O$ from a frequency converted signal 57; 60 denotes a surface acoustic wave-matched filter (hereinafter referred to as a SAW-matched filter) for extracting a QPSK-signal 61 from the output signal 59 of the bandpass filter 58; 76 and 77 denote differential detectors for detecting in-phase and quadrature components of the output signal 61 of the SAW-matched filter 60, respectively; 62 and 66 denote ($+\pi/4$) and ($-\pi/4$) phase shifters which phase shift the output signal 61 of the SAW-matched filter 60 by $+\pi/4$ and $-\pi/4$, respectively; 64 and 68 denote one-symbol delay circuits which delay the output signals of the phase shifters 62 and 66 by a one-symbol duration, respectively; 70 and 71 denote multipliers which multiply the output signal 61 of the SAW-matched filter 60 by the one symbol-delayed signals 65 and 69 independently of each other; 74 and 75 denote low-pass filters each of which extracts from the multiplied signal only baseband signal component containing an information of phase-difference between continuous two symbols, rejecting higher harmonic components; 80 denotes a decision circuit which determines whether in-phase and quadrature components 78 and 79 each containing the information of phase-difference between continuous two symbols, which are received from the low-pass filters 74 and 75, are positive or negative to thereby decide the information data sequence sent from the transmitting side and yields an output signal; and 82 denotes an output data signal provided from the data decision circuit 80.

Problem to be Solved by the Invention

In the conventional spread spectrum communication system which uses the SAW-matched filter and the differential detectors, it is necessary that a delay element for delaying a signal by a one-symbol duration be contained in each differential detector as depicted in FIG. 4. Since SAW filters are usually employed as the delay elements, two different SAW filters must be prepared. Moreover, in the spread spectrum communication system of the type using the QPSK modulation scheme for phase-modulation, differential detectors of two routes, one for extracting the in-phase signal component and the other for extracting the quadrature component, are needed; besides, it is necessary to prepare phase shifters in which arbitrary phase shift amounts can be set independently of each other so as to effect two different phase shifts of $+\pi/4$ and $-\pi/4$. Accordingly, a combination of such a plurality of elements imposes limitations on the downsizing of the circuit structure and, at the same time, requires the preparation of independent elements, inevitably constituting a restriction on the cost reduction of the device.

As a solution to the problem mentioned above, there is proposed in Institute of Electronics, Information and Communication Engineers of Japan, Technical Bulletin SST94-19 (June, 1994) entitled "SS Demodulator for Radio LAN Using a SAW Element" a SAW-matched filter for use in a spread spectrum/QPSK system. FIG. 5 shows an example of the configuration of the SAW-matched filter as applied to the spread spectrum/QPSK system.

In FIG. 5, there are placed on a piezoelectric substrate 90 two independent input/output transducers 88 and 89 for detecting in-phase and quadrature components, respectively. With a view to implementing the differential detection by using the output signals from the output transducers of the respective routes as they are, there are further disposed in series two independent output transducers so that the correlation value between the spread spectrum signal and the matched filter may be provided over two consecutive symbol periods. The phase shifts which are effected by the phase shifters of the differential detectors in FIG. 4 are implemented in FIG. 5 by spacing forward and backward output transducers 95 and 99, 96 and 100 apart by equivalents to the required phase shift amounts $+\pi/4$ and $-\pi/4$, respectively, at the carrier level corresponding to the center frequency (the IF frequency) of the SAW-matched filter as indicated by reference numerals 108 and 109. Reference numerals 91 and 92 denote input nodes for detecting in-phase and quadrature components; 93 and 94 denote input transducers for detecting in-phase and quadrature components; 95 and 96 denote the forward output transducers for detecting in-phase and quadrature components; 99 and 100 denote the backward output transducers for detecting in-phase and quadrature components; 97 and 98 denote output nodes of the forward output transducers 95 and 96: and 101 and 102 denote output nodes of the backward output transducers 99 and 100. Reference numerals 108 and 109 denote propagation distances corresponding to the carrier phase shift amounts $+\pi/4$ and $-\pi/4$, respectively; 103 denotes the length of each input transducer; 104 and 106 denote inter-chip distances; and 105 and 107 denote the lengths of the output transducers.

FIG. 6 is a block diagram illustrating an example of a differential detection system which demodulates the spread spectrum/QPSK signal through the use of the conventional SAW-matched filter depicted in FIG. 5. In FIG. 6, reference numeral 111 denotes a received signal of the intermediate frequency (IF) band converted from an RF-band spread spectrum/QPSK signal; 112 denotes a conventional SAW-matched filter for extracting the QPSK signal component from the IF-band spread spectrum/QPSK signal; 113 denotes an input transducer of the SAW-matched filter; 114 denotes a forward output transducer for quadrature component; 115 denotes a forward output transducer for in-phase component; 116 denotes a backward output transducer for quadrature component; 117 denotes a backward output transducer for in-phase component; and 118 to 121 denote output signals from the respective output transducers 114 to 117.

As referred to previously, since the phase differences for differential detection are preset between the forward output transducer and a backward output transducer of the conventional SAW-matched filter 112, the output signals 120 and 121 of the forward and backward output transducers 115 and 117, and the output signals 118 and 119 of the forward and backward output transducers 114 and 116 are multiplied by multipliers 124 and 125, respectively, and the multiplied outputs are applied to low-pass filters 128 and 129, respectively, by which it is possible to detect in-phase and quadrature output signals 130 and 131 of differential detectors. In this case, it is necessary that the forward and backward output transducers on the piezoelectric substrate be positioned with high accuracy so as to provide therebetween the phase difference of $\pm\pi/4$ at the carrier level of the input spread spectrum signal; in practice, however, minor errors occur in their positioning under the influence of electrical and temperature characteristics of the device.

Hence, fine-adjustable phase shifters 122 and 123 are usually employed as depicted in FIG. 6.

The use of such a SAW-matched filter provides the advantages (1) to (3) listed below.

(1) The SAW filter needed in the past as a delay element, which is independent of the SAW-matched filter, is unnecessary.

(2) Since the phase shift is effected between two output transducers, a phase shifter which is an external circuit is unnecessary.

(3) No divider is needed since input and output transducers for detecting in-phase and quadrature components are formed on the same substrate independently of each other.

It is expected that these merits (1) to (3) will contribute to the downsizing of the SAW-matched filter and the differential detector for the spread spectrum/phase modulating system. However, the formation of a plurality of transducers on the same piezoelectric substrate gives rise to such defects (1) to (4) as listed below.

(1) The SAW-matched filter itself becomes bulky.

(2) The influence of the feedthrough between the transducers grows, creating the possibility of the output signal being distorted.

(3) Taps of the transducers must be positioned with high accuracy so as to provide the required phase difference at the IF-band carrier level.

(4) To accommodate slight variations in the tap positioning (3), fine-adjustable phase shifters are required as external circuits of the SAW-matched filter as is the case with the prior art system.

In particular, the price of the SAW-matched filter depends largely on the package size; therefore, with the method in which input/output transducers of two routes are placed on the same piezoelectric substrate to detect in-phase and quadrature components, it is unavoidable that there are limits to the reduction of the size and cost of the SAW-matched filter.

SUMMARY OF THE INVENTION

An object of the present invention is to provide a surface acoustic wave-matched filter and a differential detection system with which it is possible to realize a small, low-cost demodulator of the spread spectrum communication system using the QPSK modulation system.

To attain the above object, the SAW-matched filter for the demodulation of spread spectrum signals according to the present invention has such a configuration as depicted in FIG. 1 in which there are formed on a piezoelectric substrate: an input transducer; a first output transducer coded in correspondence to a PN code sequence, that is, a forward output transducer; and a second output transducer, that is, a backward output transducer, coded in correspondence to the PN code sequence and disposed at the succeeding stage of the forward output transducer by the length of the PN code sequence as viewed from the input transducer.

The differential detector according to the present invention for demodulating spread spectrum/QPSK signals has such a construction as shown in FIG. 2. That is, a correlation signal from the forward output transducer of the SAW-matched filter and a correlation signal from the backward transducer are each applied into an independent two-output divider, then the one output signal of the two-output divider corresponding to the forward output transducer is multiplied by a signal which is obtained by phase shifting the one output signal of the two-output divider corresponding to the backward transducer by $+\pi/4$, and the multiplied output is applied to a low-pass filter to thereby detect a differentially detected output signal corresponding to the in-phase component of the QPSK signal. On the other hand, a signal obtained by phase-shifting the other output signal of the two-output divider corresponding to the forward output transducer by $+\pi/4$ is multiplied by the other output signal of the backward output transducer, and the multiplied output is applied to a low-pass filter to thereby detect a differentially detected output signal corresponding to the quadrature component of the QPSK signal. Then, a decision is made through utilization of information about the in-phase and quadrature components of the differentially detected output signal. It is also feasible to construct the differential detector so that the output signals, described just above not to undergo the $+\pi/4$ phase shift, are phase shifted by $-\pi/4$.

With the use of the SAW-matched filter of the present invention, it is possible to dispense with another SAW filter needed in the past as a delay element in addition to the SAW filter and to reduce the size of the latter more than one-half that in the prior art. Furthermore, since no phase difference needs to be provided at the IF-band carrier level, the limits on the accuracy of positioning the taps of the transducers can be reduced. These structural features permit reduction of the cost of the SAW-matched filter, and exclude the influence of the feedthrough which becomes an issue in the prior art, ensuring the generation of distortion-free output signals.

With the use of the differential detector according to the present invention, the shift amounts of phase shifters which need to be adjusted individually in the prior art can be set at the same value. This allows ease in adjusting them and permits the use of a single phase shifter. By this, it is possible to configure a simple and low-cost receiver for the spread spectrum communication system.

BRIEF DESCRIPTION OF THE DRAWINGS

Other objects, features and advantages of the present invention will become more apparent from the following description taken in conjunction with the accompanying drawings, in which.

DETAILED DESCRIPTION OF THE PREFERRED EMBODIMENTS

Embodiments

A description will be given of an embodiment of the SAW-matched filter according to the present invention which is used to demodulate spread spectrum signals.

Figure 1:
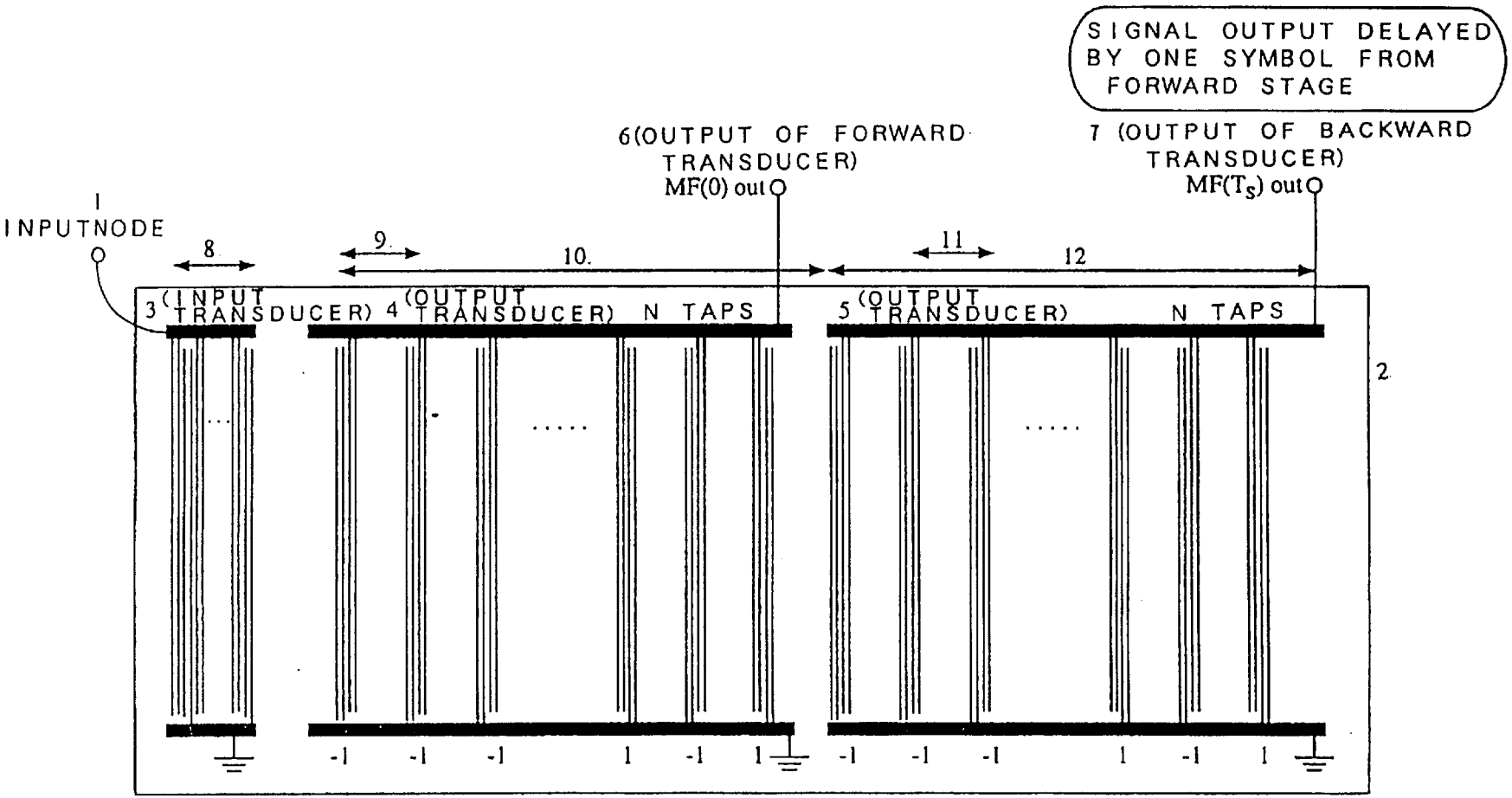
FIG. 1 is a diagram illustrating an embodiment of a SAW-matched filter for spread spectrum signals according to the present invention.

FIG. 1 illustrates an example of the SAW-matched filter which embodies a system of the present invention and in which the PN code used for spectrum spreading is of N-bit. In FIG. 1, there are disposed in series on a piezoelectric substrate 2 an input electrode 3, a first output transducer 4 coded in correspondence to the PN code sequence for spectrum spreading , that is, a forward output transducer, and a second output transducer 5, that is, a backward output transducer coded in correspondence to the PN code sequence and disposed at the succeeding stage of the forward output transducer 4 by the length of the PN code sequence (corresponding to 10 and 11 shown in FIG. 1) as viewed from the input transducer 3.

Figure 2:
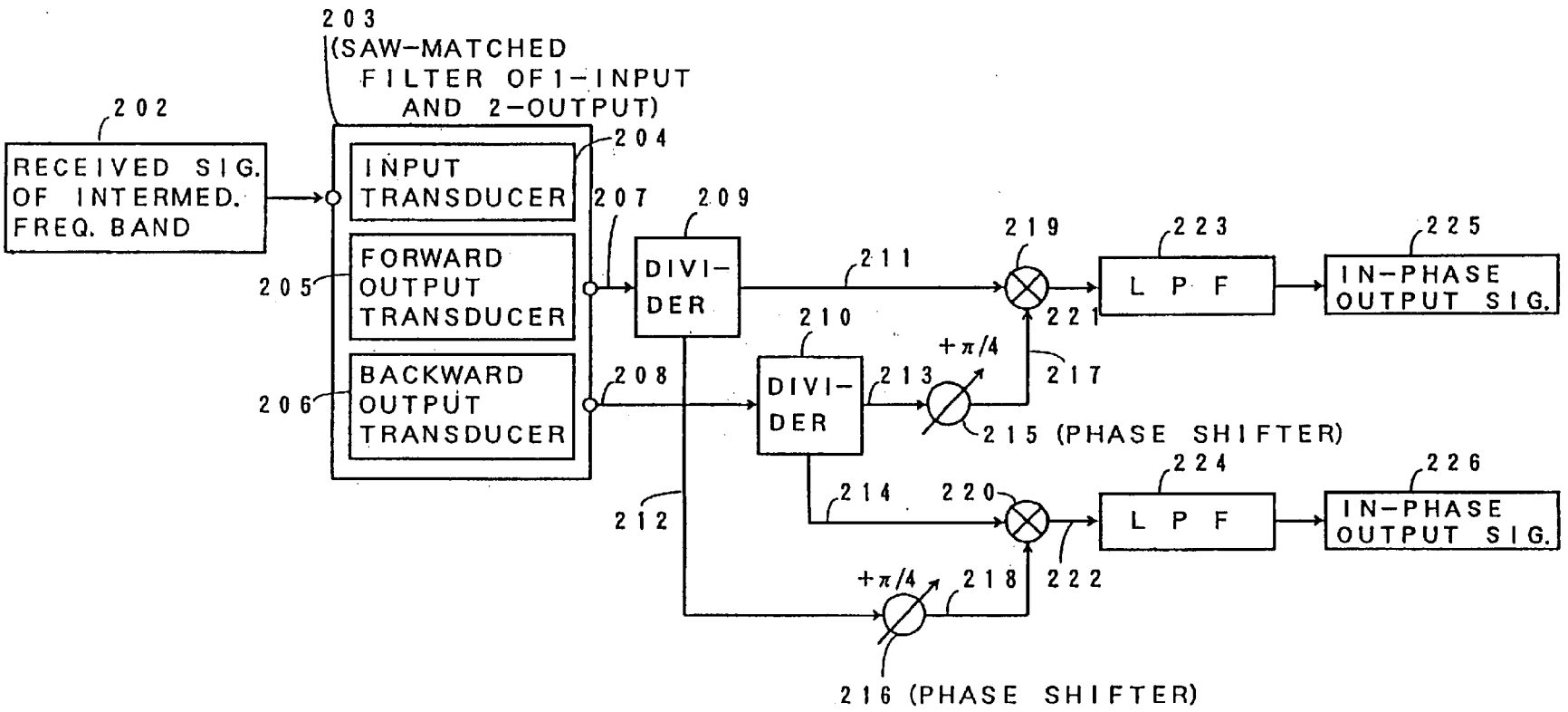
FIG. 2 is a block diagram illustrating an embodiment of a differential detector using the SAW-matched filter according to the present invention for demodulating spread spectrum signals.
Figure 3:
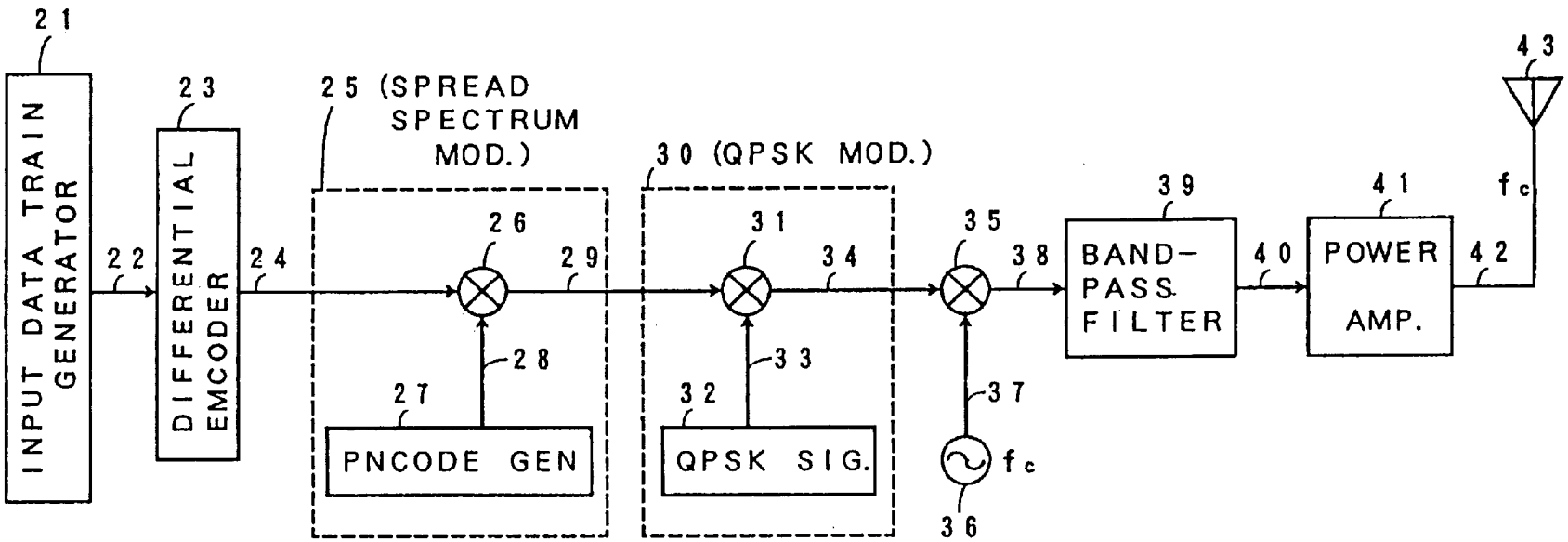
FIG. 3 is a block diagram depicting an example of a transmitter of a conventional spread spectrum communication system.
Figure 4:
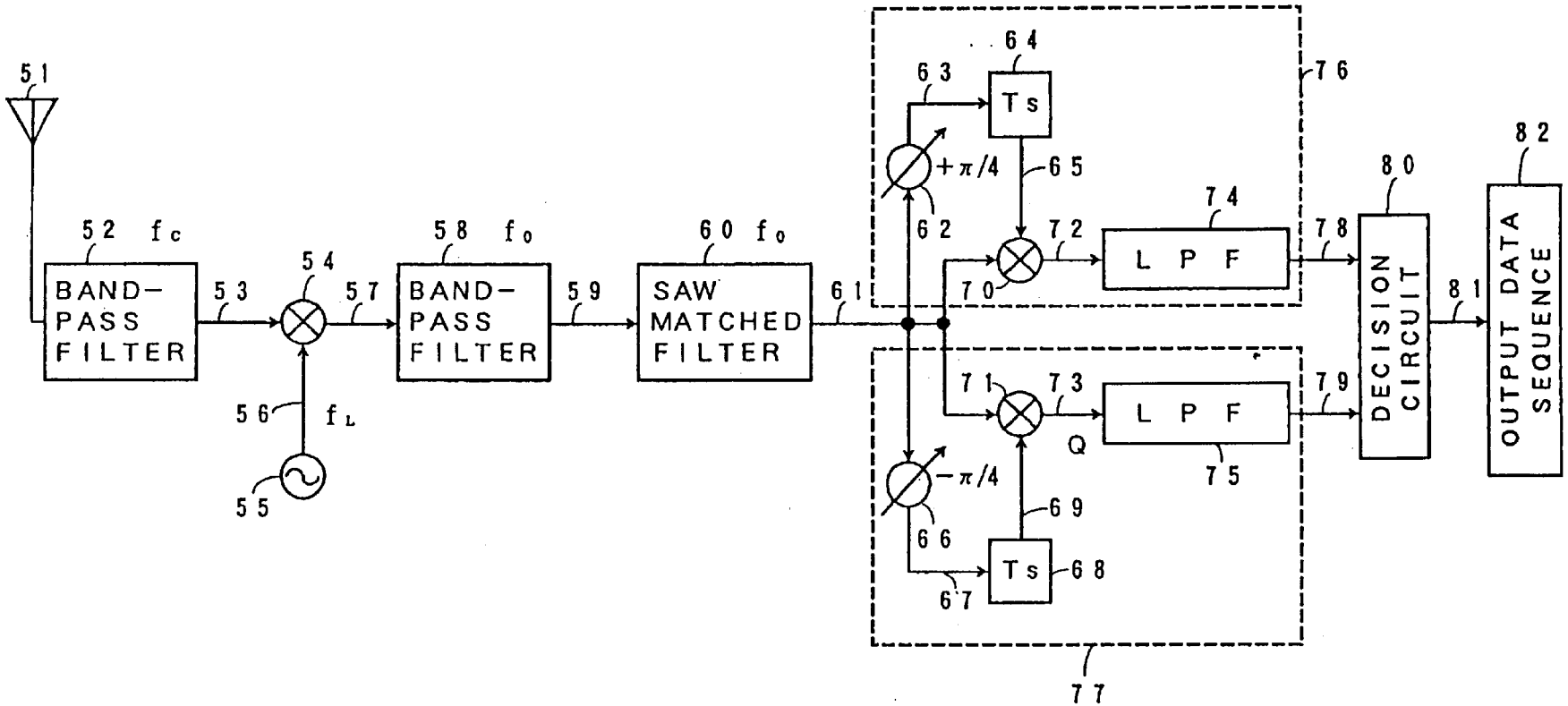
FIG. 4 is a block diagram depicting an example of a receiver of a conventional spread spectrum communication system.
Figure 5:
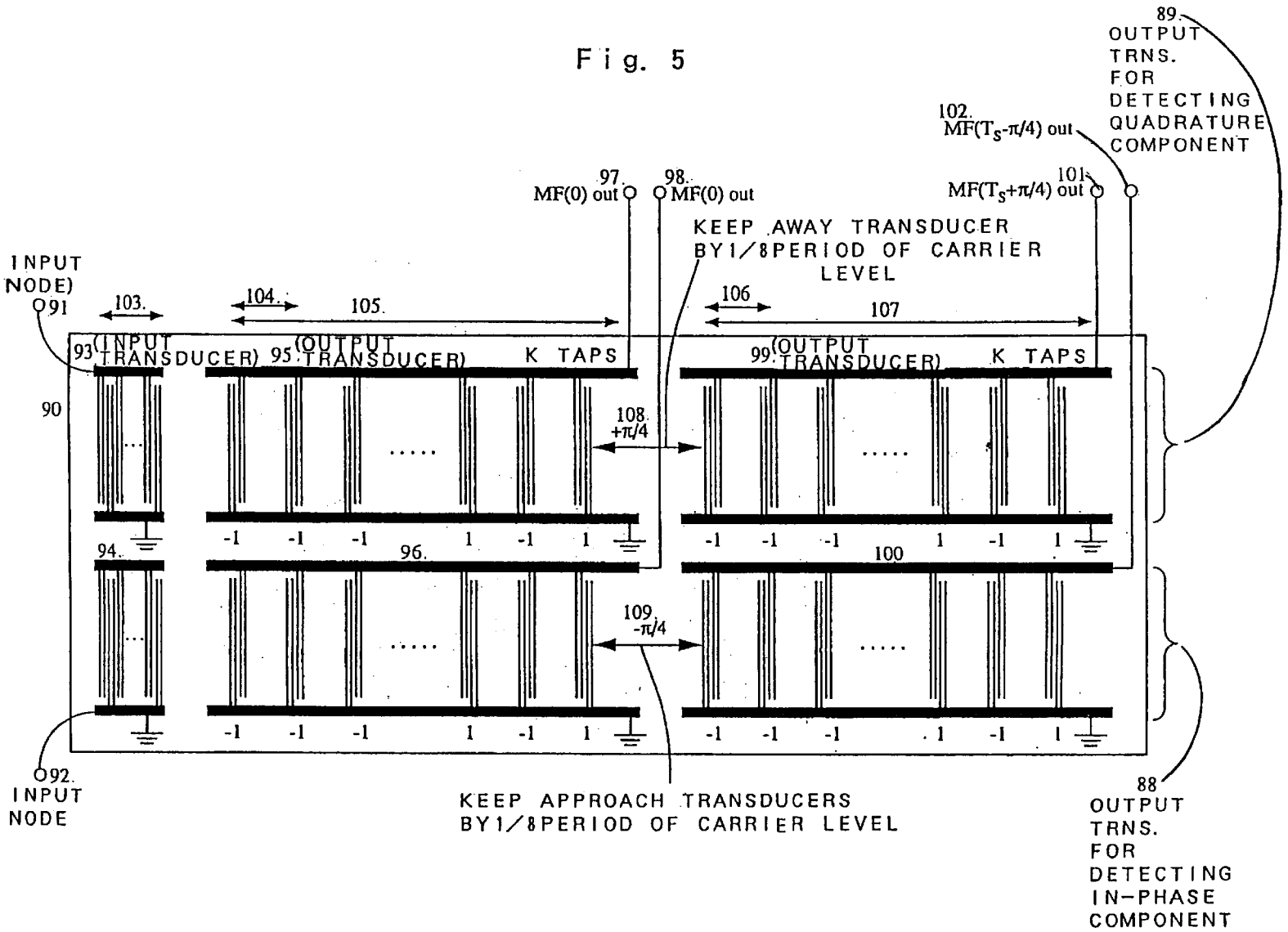
FIG. 5 is a diagram depicting an example of a conventional SAW-matched filter for demodulating spread spectrum signals.
Figure 6:
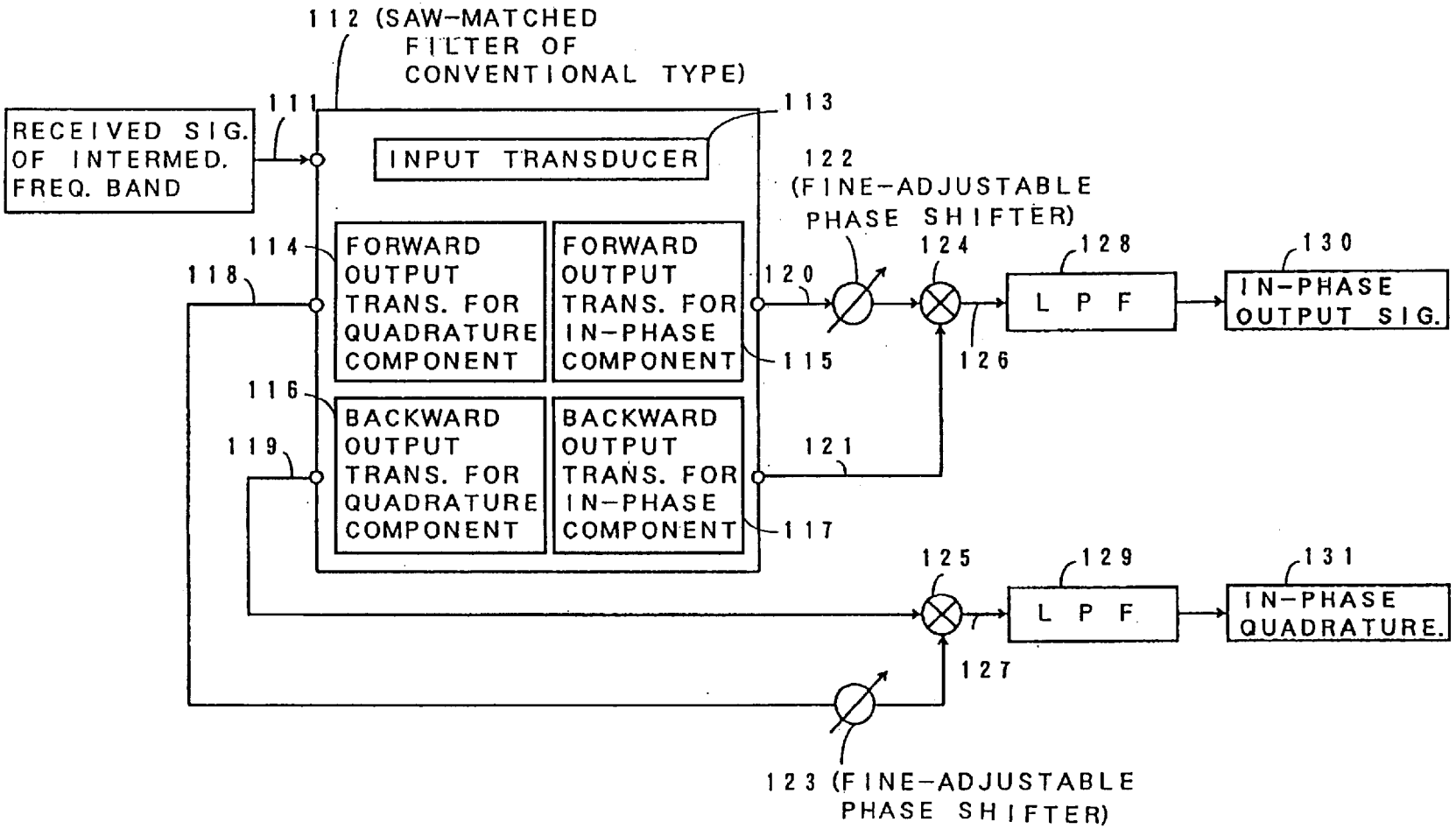
FIG. 6 is a block diagram depicting an example of a differential detector using the conventional SAW-matched filter for demodulating spread spectrum signals.

By realizing such arrangement of the two independent output transducers 4 and 5 on the piezoelectric substrate 2 so that the value of correlation between the spread spectrum signal and the matched filter may be obtained over two symbol periods, it is possible to configure the differential detector of FIG. 2 which uses the output signal 6 of the forward transducer and the output signal 7 of the backward transducer as they are. Reference numeral 1 denotes an input node of the SAW-matched filter according to the present invention; 8 denotes the length of the input transducer 3; 9 and 11 denote inter-chip distances; and 10 and 12 denote the lengths of the output transducers 4 and 5.

Next, a description will be given of an embodiment of the differential detector which employs the SAW-matched filter according to the present invention for demodulating spread spectrum signals.

FIG. 2 illustrates in block form an embodiment of the differential detector for demodulating spread spectrum/quadrature phase-shift keyed-signals (hereinafter referred to as QPSK signals) through utilization of the SAW-matched filter shown in FIG. 1. In FIG. 2, reference numeral 202 denotes a received signal of the intermediate frequency band (hereinafter referred to as a received IF band signal) frequency converted from an RF-band spread spectrum/QPSK signal; 203 denotes a proposed one-input-two-output SAW-matched filter which extracts the QPSK signal component from the IF-band spread spectrum/QPSK signal; 204 denotes an input transducer of the SAW-matched filter 203; 205 denotes a forward output transducer of the SAW-matched filter 203; 206 denotes a backward output transducer of the SAW-matched filter 203; 207 denotes the output signal of the forward output transducer 205; and 208 denotes the output signal of the backward transducer 206.

As mentioned previously, since a delay amount corresponding to the length of the PN code sequence is provided between the forward output transducer 205 and the output backward output transducer 206, the differential detection can be achieved using their output signals 207 and 208. At first, the output signals 207 and 208 of the forward output transducer 105 and the backward output transducer 206 of the SAW-matched filter 203 are input into two-output dividers 209 and 210, respectively. The one divided signal 211 of the forward output transducer 205 is applied intact to a multiplier 219, whereas the one divided signal of the backward output transducer 206 is applied to a phase shifter 215, in which it is subjected to a $+\pi/4$ phase shift and from which the thus phase-shifted signal 217 is applied to the multiplier 219. The two input signals 211 and 217 thereto are multiplied by the multiplier 219, and the multiplied output is applied to a low-pass filter 223, by which it is possible to detect a differential detector output 225 corresponding to the in-phase component of the QPSK-modulated data signal. On the other hand, the other divided signal 212 of the two-output divider 209 corresponding to the forward output transducer 205 is applied first to a phase-shifter 216, in which it is phase shifted by $+\pi/4$ and from which the thus phase-shifted signal 218 is applied to a multiplier 220; and the other divided signal 214 of the two-output divider 210 the backward output transducer 206 is applied to the multiplier 219. The two signals 218 and 214 are multiplied by the multiplier 219, and the multiplied output is provided to a low-pass filter 224, by which it is possible to detect a differential detector output 226 corresponding to the quadrature component of the QPSK-modulated data signal.

As described above, the use of the SAW-matched filter and the differential detector according to the present invention enables constructing a receiver for the spread spectrum communication system which is smaller, simpler and less expensive than in the past. The present invention provides the advantages listed below.

(1) The SAW filter needed in the past as a delay element independent of the SAW-matched filter can be dispensed with, and the SAW-matched filter can be reduced in size more than one-half that in the past.

(2) Since no phase difference needs to be provided at the IF-band carrier level, the limits on the accuracy of positioning the taps of the transducers can be reduced.

(3) Since it is possible to exclude the influence of the feedthrough which becomes an issue in the prior art, the distortion of the output signal can be suppressed.

(4) Since the shift amounts of phase shifters which need to be adjusted individually in the prior art differential detector can be set at the same value, no cumbersome adjustment is involved.

(5) It is possible to reduce the package size of the SAW-matched filter and its cost and to realize a simple-structured and hence lowcost receiver for the spread spectrum communication system.

What we claim is:

1. A differential detection system which is provided with a one-input-two-output surface acoustic wave-matched filter to demodulate a data signal, subjected to a four-phase modulation by a pseudo-noise code sequence, from a phase-modulated signal obtained by a spread spectrum modulation of said data signal;

said filter comprising: an input transducer provided on a piezoelectric substrate; a first output transducer coded in correspondence to said pseudo-noise code sequence and provided on said piezoelectric substrate; and a second output transducer coded in correspondence to said pseudo-noise code sequence and disposed on said piezoelectric substrate at the succeeding stage of said first output transducer by the length of said pseudo-noise code sequence as viewed from said input transducer; and wherein:

correlation signals from said first and second output transducers of said surface acoustic wave-matched filter are input into respective ones of independent two-output dividers;

the one output signal of said two-output divider connected to said first output transducer is multiplied by a $(+\pi/4)$ phase-shifted version of the one output signal of said two-output divider connected to said second output transducer, so that the multiplied output signal is applied to a low-pass filter to obtain a differentially detected output signal corresponding to an in-phase component of said four-phase modulated data signal;

a ($+\pi/4$) phase-shifted version of the other output signal of said two-output divider connected to said first output transducer is multiplied by the other output signal of said two-output divider connected to said second output transducer, so that the multiplied output signal is applied to a low-pass filter to obtain a differentially detected output signal corresponding to a quadrant component of said four-phase modulated data signal; and decision on said data signal is completed by the use of said differentially detected output signals corresponding to said in-phase and quadrature components of said data signal.

* * * * *